United States Patent [19]

Brandl et al.

[11] Patent Number: 5,050,934

[45] Date of Patent: Sep. 24, 1991

[54] SHEARING MACHINE WITH ROOF-BOLT DRILLING AND SETTING DEVICES

[75] Inventors: Erich Brandl, Grosslobming; Oswald Tutzer, Graz; Alfred Zitz, Zeltweg, all of Austria

[73] Assignee: Voest-Alpine Zeltweg Gesellschaft m.b.H., Linz, Austria

[21] Appl. No.: 523,527

[22] Filed: May 15, 1990

[30] Foreign Application Priority Data

May 17, 1989 [AT] Austria ..... 1188/89

[51] Int. Cl.[5] ..... E21D 19/04; E21D 20/00

[52] U.S. Cl. ..... 299/33; 299/76

[58] Field of Search ..... 299/11, 31, 33, 64, 299/76; 405/138, 142

[56] References Cited

U.S. PATENT DOCUMENTS

| | | | |
|---|---|---|---|
| 4,098,538 | 7/1978 | Hilton | 299/33 |
| 4,662,685 | 5/1987 | Bärnthaler et al. | 299/33 |
| 4,740,037 | 4/1988 | Eager et al. | 299/33 X |
| 4,865,390 | 9/1989 | Shrader et al. | 299/33 X |

FOREIGN PATENT DOCUMENTS

| | | | |
|---|---|---|---|
| 617592 | 7/1978 | U.S.S.R. | 299/33 |
| 2144786 | 3/1985 | United Kingdom | 299/33 |

*Primary Examiner*—David J. Bagnell

*Attorney, Agent, or Firm*—Cushman, Darby & Cushman

[57] ABSTRACT

A shearing machine with roof-bolt drilling and setting devices which are jointedly connected to the shearing machine and can be hydraulically braced between roof and floor of the roadway. A multiplicity of roof-bolt drilling and setting devices are connected to a common supporting frame, the supporting frame being connected to the shearing machine via guide bars running in the longitudinal direction of the machine.

13 Claims, 4 Drawing Sheets

SHEARING MACHINE WITH ROOF-BOLT DRILLING AND SETTING DEVICES

BACKGROUND OF THE INVENTION

1. Field of the Invention

The invention relates to a shearing machine with roof-bolt drilling and setting devices, which roof-bolt drilling and setting devices are jointedly connected to the shearing machine and can be hydraulically braced between roof and floor of the roadway.

2. Description of the Prior Art

U.S. Pat. No. 4,098,538 discloses an extracting machine wherein a bracing of the machine in a funnel is performed by means of rams which can be pressed against the roof of the funnel and a strut connecting the rams, in order to ensure the simultaneous use of a plurality of extracting tools with reliable positioning of the machine.

Shearing machines of the type mentioned above, in particular selective cut heading machines with roof-bolt drilling and setting devices have already been proposed in various forms. For example, Austrian Patent Specification 381,986 discloses a shearing machine wherein a shielding is connected to the machine displaceably in the horizontal direction. In the plane of the shielding connected to the machine in this way, there is connected to a supporting frame, roof-bolt drilling and setting devices with which roof-bolt drill holes can be drilled into the roof and cover boards, or roof elements can be fixed for a provisional or definitive support. In the case of the known design, the entire supporting frame was connected to the machine displaceably in the longitudinal direction of the machine and vibrations of the machine during shearing were naturally transmitted via the longitudinal guide of the supporting frame to the shielding and the roof-bolt drilling and setting device. The known device was indeed braced for anchoring between roof and floor and this bracing served at the same time to improve the absorption of the cutting forces. The cutting forces or forces of reaction were introduced into the machine and the stability of the machine was improved by the chosen type of connection of the machine to the supporting frame after bracing the supporting frame against roof and floor. However, the result of this is that the roof-bolt drilling and setting devices could not be kept free from vibrations of the machine during shearing.

In order to prevent a breaking-away of the roofbolt drill holes during drilling, in particular on a crumbly roof, it has therefore already been proposed to use separate devices for making the roof-bolt drill holes, although it was consequently not possible for the roof-bolt drilling and setting devices to be taken along during travelling of the machine. Rather, the roof-bolt drilling and setting devices had to be moved separately from the machine, in order to be positioned close to the heading face.

Austrian Patent Specification 377,573 has also disclosed a shearing machine on which roof-bolt drilling and setting devices are connected at the sides by means of guide bars. This design allows positioning of the roof-bolt drilling and setting devices by means of hydraulic cylinder-piston units connected to the guide bars and, after bracing against roof and floor of rams connected to the roof-bolt drilling and setting devices, a substantial isolation of the roof-bolt drilling and setting devices from vibrations of the machine could be achieved by depressurizing the cylinders for orienting the guide bars. However, what is disadvantageous about such a design is that it was only ever possible to position individual roof-bolt drilling and setting devices arranged at the sides of the machine and therefore an exact positioning of roof-bolt holes in a cross-sectional plane of the roadway could not be readily accomplished. In addition, the complexity of the positioning and the number of cylinder-piston units required for this was relatively great.

It has also already been proposed to connect roof-bolt drilling and setting devices to a common supporting frame and to arrange in this common supporting frame cylinder-piston units for the pressing against the roof and cylinder-piston units for the pressing against the floor. In order to be able to connect such a supporting frame structure stably to the heading machine or shearing machine, guide bars which jointedly connect the free ends of the cylinder-piston units to the shearing machine were arranged running in the longitudinal direction of the shearing machine. In the case of such a design, both the cylinder-piston units which can be pressed against the roof and the cylinder-piston units which can be pressed against the floor had to be retracted in order to be able to move the machine along. However, with such a design, an isolation of oscillations or vibrations of the machine was not possible since the points of articulation of the cylinder-piston units for pressing against roof bars and floor plates were provided on a common bearing bracket connected to the machine frame and consequently vibrations were transmitted into the supporting frame via this bearing bracket rigidly connected to the machine. The arrangement of a multiplicity of cylinder-piston units one above the other in the vertical direction for pressing against the roof and the floor also results in a reduction in the free space for the arrangement of roof-bolt drilling and setting devices. If, as is likewise already known, such supporting frames are connected to shieldings, in addition a space must also be kept free for the movement of the shearing arm or the loading ramp of a shearing machine, with the result that only a relatively confined space is available for the arrangement of roof-bolt drilling and setting devices.

SUMMARY OF THE INVENTION

The invention is now based on the object of providing a shearing machine of the type mentioned above that allows the anchorage to be brought in during cutting directly behind the cutting tool and at the same time ensures that the roof-bolt drilling and setting devices remain in their exact position during shearing operation as well as being kept substantially free from vibrations. To achieve this object, the shearing machine according to the invention comprises a multiplicity of roof-bolt drilling and setting devices that are connected to a common supporting frame, the supporting frame is connected to the shearing machine via guide bars running in the longitudinal direction of the shearing machine. The measure of arranging a multiplicity of roof-bolt drilling and setting devices on a common supporting frame is in principle known per se, but until now such a supporting frame has not been connected to the shearing machine by means of guide bars which leave the advancing machine a limited vertical movement without this movement being transmitted directly to the supporting frame.

With the chosen type of articulation, there is only support for absorbing the cutting forces in the longitudinal direction of the roadway, but vibrational forces, which generally act vertically, can be kept away from the roof-bolt drilling and setting device, as a result of which more exact drill holes can be accomplished without the risk of a breaking-away of the drill holes. In a particularly simple way, according to the invention, the design may be arranged such that two upper guide bars and two lower guide bars are provided in each case between supporting frame and shearing machine, as a result of which a relatively simple and lightweight structure is obtained, which can be braced between roof and floor without great complexity, it being possible to accomplish guidance for the supporting frame by the pairs of guide bars by the setting-up of a multibar linkage.

According to a preferred embodiment, the design is arranged such that the supporting frame is formed by rams which can be braced between floor and roof and roof bars jointedly connected to the rams, in particular a common roof bar for two rams, and floor support plates, as a result of which a portal construction is obtained for the supporting frame, which can be positioned in the desired way relative to the machine, a compact and intrinsically stable structure being created by the preferable use of a common roof bar over the carriers articulated on the machine.

Such a design also has the advantage that only rams for the pressing the support plates against the floor have to be extended in order to press the supporting frame with its roof bars or the common roof bar against the roof. If, in the case of such an arrangement, as provided by the invention, roof-bolt drilling and setting devices are fixed to the supporting frame, a predetermined distance of the roof-bolt drilling and setting devices from the roof is obtained immediately after pressing into place the roof bar(s) with the result that the drill holes can be made without complex adjusting work on the roof-bolt drilling and setting devices immediately and more quickly than in the case of devices with which the roof-bolt drilling and setting devices have to be adjusted before commencing drilling. The measure of jointedly connecting the roof bars to the supporting frame also permits allowance to be made for unevennesses of the roof and, if desired, to prescribe inclined positions of the supporting frame which make it easier to set roof bolts right up to just in front of the heading face. The inclined positions of the roof bar(s) or of the entire supporting frame which may result from unevennesses of the roof can be compensated by suitably designed points of articulation of the guide bars. In order to be able to compensate in a simple way for such inclined positions between the rams and the roof bar(s) as well, the design is advantageously arranged such that the roof bar is supported via crowned bearing surfaces on the rams, thereby allowing two degrees of freedom to be accomplished for relative movement between the rams and the roof bar(s).

For retracting the supporting frame with the roof bars, according to the invention it is sufficient to retract the support rams which are jointedly connected to the support plates, the design for retracting the supporting frame being advantageously arranged such that the retractability of the supporting frame is limited during retraction of the support rams by stops. With such stops, the respectively desired retracting distance can be limited to the necessary minimum, so that anchorage work can be commenced again quickly once the shearing machine has been moved on. In this case, the stops may be designed in a simple way as vertically adjustable stops.

In a particularly simple way, the design is arranged here such that the stops for limiting the retracting movement of the supporting frame are formed by a telescopically slidable strut which is jointedly articulated on the shearing machine and the supporting frame, the point of articulation of the strut on the shearing machine being different from the point of articulation of the upper guide bar on the shearing machine. Such a design allows the sliding-in of the telescopically slidable strut by a predetermined amount limited by vertically adjustable stops, with the result that, for moving the machine along, in fact only the smallest retraction movement, adapted to the cross-section of the roadway, is necessary, immediately after which a raising of the floor plates or support plates, which can be pressed against the floor, takes place.

In order to permit exact drill holes in a cross-sectional plane and to allow prefabricated boarding elements or roof bar elements to be used to a great extent, the design is advantageously arranged such that the roof-bolt drilling and setting devices between the rams are arranged in the plane of the supporting frame formed by the rams, in particular the axes of the rams. In the case of such a design, support elements on which the drill holes for fixing the roof bolts have already been made can be used, since a correspondingly exact drilling in the roof at the predetermined grid spacings can be ensured.

For fixing the roof-bolt drilling and setting devices to the supporting frame, the design is advantageously arranged such that the roof-bolt drilling and setting devices are connected to plates which are connected to the cylinders of the rams, the plates being guided by guides parallel to the longitudinal axis of the roof bars crossing the longitudinal axis of the roadway. In this way, the plates which bear the roof-bolt drilling and setting devices are always aligned in the axial direction of the rams and, with a design of the jointed connection between the rams and the roof bar(s) in which the center point of the mounting lies in the center plane of the roof bar(s), an automatic centering of the axes of the roof-bolt drilling and setting devices in the center plane of the roof bar(s) is accomplished, in which plane clearances for the passage of the roof bolts are provided. In this case, the plates at the same time fulfil a shielding function while leaving free the space required for the vertical movement of the shearing arm and, if applicable, the loading ramp, as a result of which anchoring work up to just in front of the heading face is possible without interrupting the shearing work, since any danger posed is reduced by such protective measures.

It is advantageous if a small number of rams suffice for supporting the supporting frame on the floor side, two rams generally being enough. The design is in this case advantageously arranged such that the support plates of the rams for pressing against the floor are arranged outside the width of the loading device. In the case of such designs, virtually the entire height of the supporting frame and a large width of the same remain freely available for the arrangement of roof-bolt drilling and setting devices, which themselves are mounted on the plates displaceably in their axial direction, so that a large number of roof-bolt drill holes with great length can be drilled simultaneously. In order to be able to take anchoring work up to just in front of the heading face and in particular to keep the unsupported area as short as at all possible, in particular on a crumbly roof, the device is advantageously arranged such that the length of the guide bars which connect the supporting frame to the shearing machine is dimensioned in such a way that the supporting frame lies closer to the heading face at the roof than it does-at the floor.

BRIEF DESCRIPTION OF THE DRAWINGS

The invention is explained in more detail below with reference to an exemplary embodiment which is represented diagrammatically in the drawing, wherein.

DETAILED DESCRIPTION OF THE PRESENTLY PREFERRED EXEMPLARY EMBODIMENT

Figure 1:
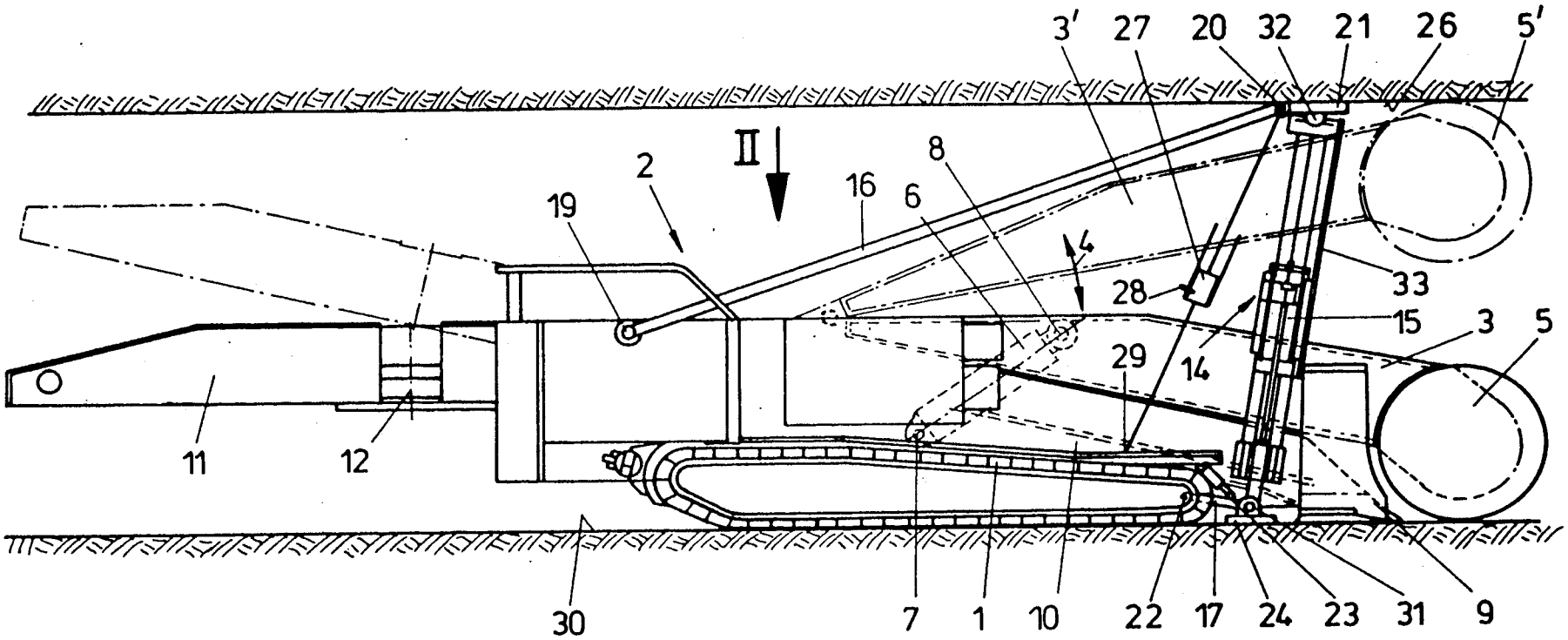
FIG. 1 shows a diagrammatic side view of a shearing machine according to the invention.

In FIG. 1, a shearing machine 2 which can travel on a crawler undercarriage 1 is shown, a rotatably mounted shearing drum 5 being arranged on a jib 3, which can be pivoted in the direction of the double-headed arrow 4. The pivoting capability of the jib 3 is in this case provided by a cylinder-piston unit 6, which is mounted in a swivelling manner on the machine frame of the shearing machine at 7 and in a swivelling manner on the jib at 8. The lowered position of the shearing arm 3 and of the shearing drum 5 are indicated there in solid lines, while a raised position is indicated in broken lines by 3' and 5', respectively.

The drive of the shearing drum in this case takes place in a known way, for example by means of a motor arranged in the jib 3, at least a part of the transmission being arranged in a known way inside the shearing drum. However, for the sake of clarity, these details are not shown.

For receiving the sheared or crushed material, the shearing machine 2 also has a loading device 9, formed by a ramp, which opens out into a conveyor 10, which extends in the longitudinal direction of the machine and is only diagrammatically indicated. The conveyor 10 is in this case vertically adjustable at its end 11, arranged at the rear end of the machine, as well as laterally able to swivel about a vertical axis 12, as ling of the conveyor takes place in this case in a known way, for example by means of a cylinder-piston unit 13.

Figure 2:
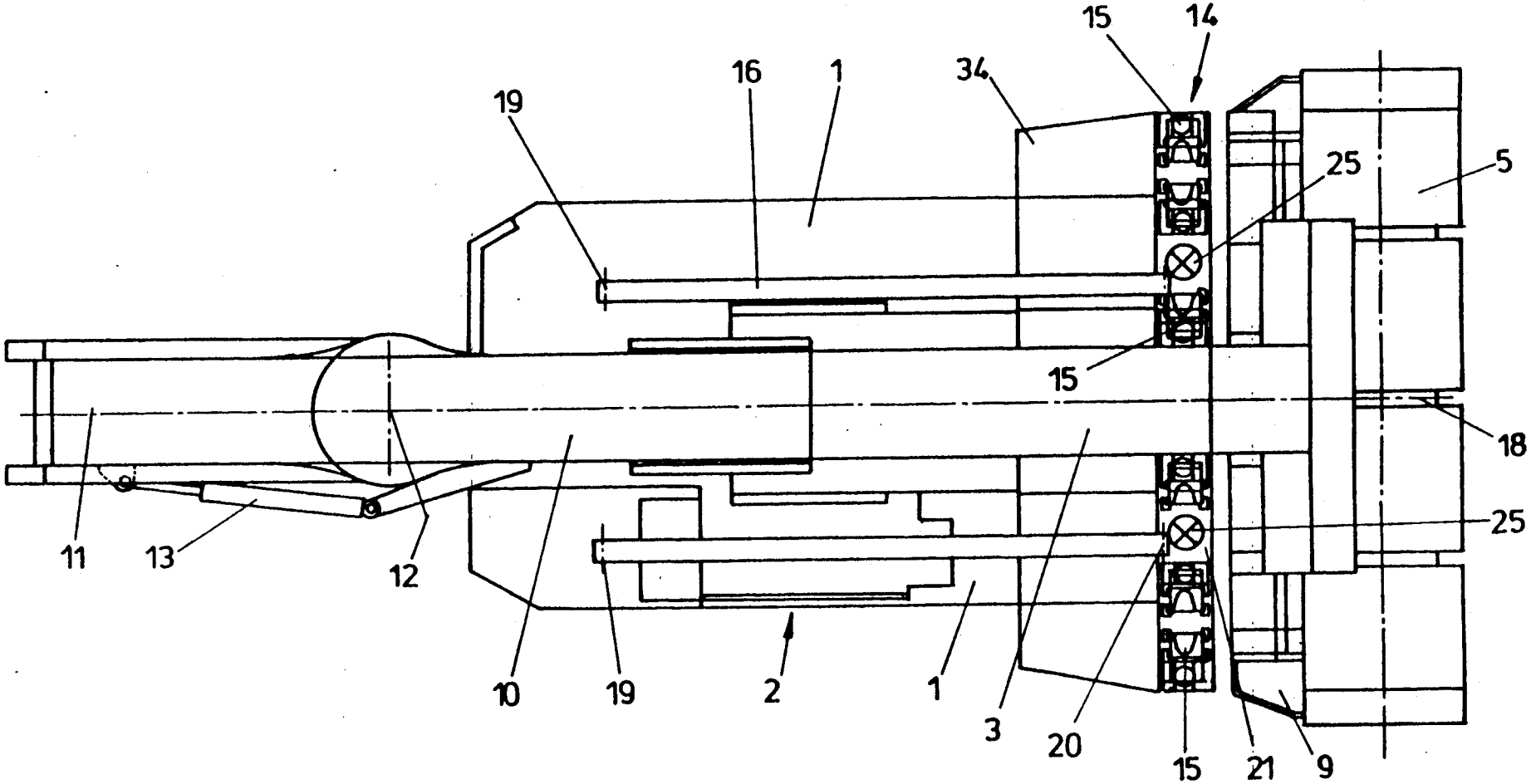
FIG. 2 shows a plan view in the direction of the arrow II of the shearing machine according to FIG. 1.

In the region of the front end of the machine directly behind the shearing drum 5 there is provided a supporting frame 14, to which a multiplicity of roof-bolt drilling and setting devices 15 are connected, which extend at a distance from one another transversely over virtually the entire width of the extracted heading face, as can be seen clearly in FIG. 2. The supporting frame 14 is in this case jointedly connected to the shearing machine by means of guide bars 16 and 17 running in the longitudinal direction of the machine, the guide bars 16 and 17 generally being arranged as pairs of guide bars symmetrically to the longitudinal axis of the machine, which is diagrammatically indicated in FIG. 2 by 18. The upper guide bars 16 are in this case articulated on the machine frame in a swivelling manner about an axis 19 and on a preferably common roof bar 21 about a diagrammatically indicated axis 20. The swivel axes of the guide bars 17 are denoted by 22 and 23, support plates 24 for pressing the supporting frame 14 against the floor also being provided in FIG. 1. The supporting frame is in this case formed altogether by the roof bar 21, the floor support plates 24 and rams 25 arranged jointedly in between, the rams 25 being arranged between the roof-bolt drilling and setting devices 15. If the rams designed as cylinder-piston units 25 are retracted, a lifting-off of the roof bars 21 from the roof 26 takes place, the retractability of the supporting frame 14 and of the roof bars 21 being limited by a telescopically slidable strut 27, which has diagrammatically indicated stops 28 for adaptation to different excavated heights. After a retraction of the supporting frame and consequently retraction of the strut 27 as far as a chosen stop 28, upon a further retraction of the rams or cylinder-piston units 25 there takes place a lifting-off of the floor plates 24, in order to permit in this way a maneuvering of the complete shearing machine 2. The strut 27 is in this case articulated jointedly on the machine frame at 29 and also jointedly on the roof bar 21 or on the cylinder 25, it being possible for the point of articulation of the strut 27 to coincide with the jointed point of articulation of the guide bar or bars 16 on the roof bar. The strut 27 is not shown in FIG. 2 for the sake of clarity.

The supporting frame is supported on the floor directly behind the loading ramp 9 and in front of the crawler undercarriages 1 and the length of the guide bars 16 and 17 is dimensioned in such a way that the supporting frame lies closer to the heading face at the roof 26 than it does at the floor 30. By fixing the roof-bolt drilling and setting devices to the supporting frame at plates 33, which is not explained in any more detail in FIG. 3, the entire length of the supporting frame can be used for the movement of the roof-bolt drilling and setting devices, with the particular result that long roof bolts can also be set. Furthermore, once the supporting frame 14 has been fixed by bracing between roof and floor, a multiplicity of roof bolts can be set simultaneously in a defined way, the chosen length of the guide bars 16 and 17 having the effect of setting a corresponding inclination for setting of the roof bolts and it being possible for roof bolts to be set as close as possible to the heading face.

Along with the secure fixing of the supporting frame for setting the roof bolts by means of the roofbolt drilling and setting devices 15 connected to the supporting frame 14, the bracing of the supporting frame 14 by means of the guide bars 16 and 17 also has the effect of fixing the advancing machine in the support, the swivelling articulation of the guide bars 16 and 17 both on the machine frame and on the supporting frame and the roof bars and support plates connected to the supporting frame jointedly at 31 and 32, respectively, permitting a vertical movement, within limits, of the advancing machine without causing any influence on the supporting frame braced between roof and floor and consequently on the roof-bolt drilling and setting devices. Consequently, there remains a degree of freedom for an evasive movement of the machine as a reaction to the cutting forces introduced via the drum, without any influencing of the position of the roof-bolt drilling and setting devices.

Figure 3:
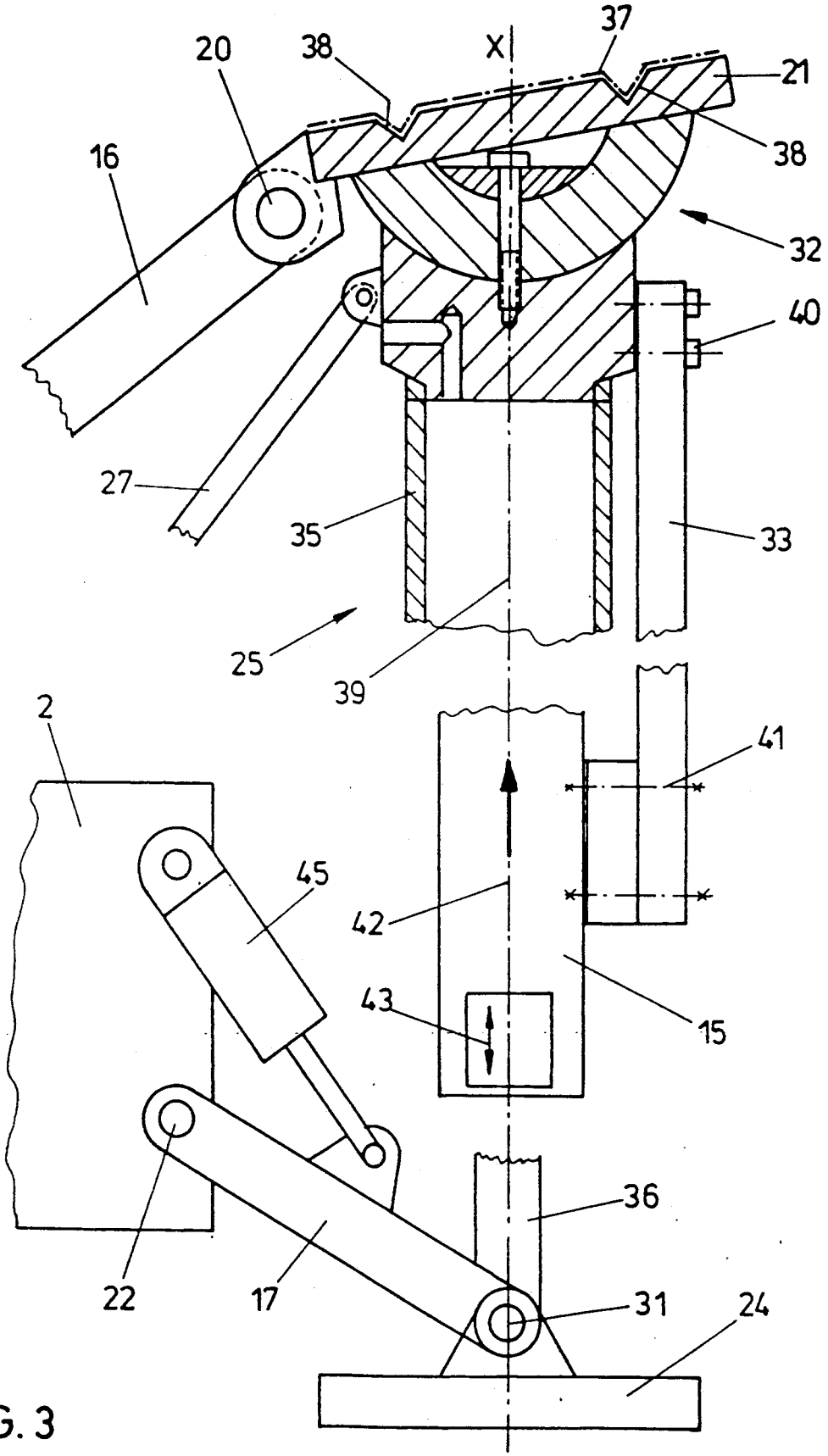
FIG. 3 shows on an enlarged scale the articulation of a ram on a roof bar and a support plate with the retaining means for a roofbolt drilling and setting device.

In the enlarged representation according to FIG. 3, the reference numerals of FIGS. 1 and 2 have been retained for the same components. In this case, a ram 25, which is braced between a roof bar 21 and a floor support plate 24, is only partially represented, and the cylinder of the ram 25 is denoted by 35 and the piston is denoted by 36. In the representation according to FIG. 3, the jointed mounting between the ram 25 or its cylinder 35 and the roof bar is formed by a ball-socket retaining means, which permits an extensive swivelling of the roof bar relative to the cylinder 35 of the ram 25. The ball-socket mounting 32 is designed in this case in such a way that the center point of the ball lies in the centre plane X of the roof bar 21, both the roof bar and a boarding element 37, which rests thereupon and, with appropriate profiling, is held in recesses 38 of the roof bar, having in the center plane X clearances for the passage of roof bolts, these clearances lying in the axis 39 of the ram 25 as well as the axis of the roof-bolt drilling and setting devices 15, which coincides with the said axis of the ram. In this way, a centering of the roof bolts relative to the clearances (not shown in any more detail in FIG. 3) in the roof bar 21 as well as in the boarding element 37 is automatically accomplished, with the result that the roof bolts can be set simultaneously immediately after pressing into place of the roof bar 21 following extension of the ram 25.

As shown in more detail in FIG. 3, the fixing of the roof-bolt drilling and setting devices 15 to the rams 25 of the, in particular common, roof bar 21 and the supporting frame 14 formed by floor support plates 24 takes place in such a way that, on both sides of the jib which can only be pivoted in the vertical direction, in each case a cylinder 35 of a ram 25 is fixed to a plate 33, for example by means of a screw joint 40. Fixed in turn, for example by a screw joint 41, to this plate 33 which, as can be seen in FIG. 1, only extends up to the region of the upper edge of the loading device 9, are the roof-bolt drilling and setting devices 15, the latter having in a known way a shifting drive along the axis 42, which coincides with the axis 39 of the ram 25, this being indicated by the double-headed arrow 43. Due to the shifting drive of the roof-bolt drilling and setting devices 15, the entire vertical distance between the roof bar 21 and the floor support plates 24 can consequently be utilized for the roof-bolt drilling and setting devices. Due to the fixing of the plates 33 to the cylinder 35 of the rams 25, the supporting plates 33 are always aligned in the axial direction of the rams 25, and an exact pressing against the roof or the floor always takes place due to the jointed arrangement of the rams 25 with respect to the roof bar 21 and the floor support plates 24.

Instead of or in addition to using a telescopically extendable strut 27, which in FIG. 3 is articulated in a swivelling manner directly on the cylinder 35 at 44, to limit the retracting movement of the supporting frame 14 and to lift off the floor plates 24 there may be arranged between the machine frame and the lower pair of guide bars 17 a cylinder-piston unit 45, with which the abovedescribed vertical movement, possible within limits, of the machine frame as a reaction to cutting forces introduced is prevented. The blocking of this lower pair of guide bars 17 has the result that the support by means of the guide bars 16 and 17 and the supporting frame forms a rigid system with the shearing machine, which permits greater cutting forces to be absorbed.

Figure 4:
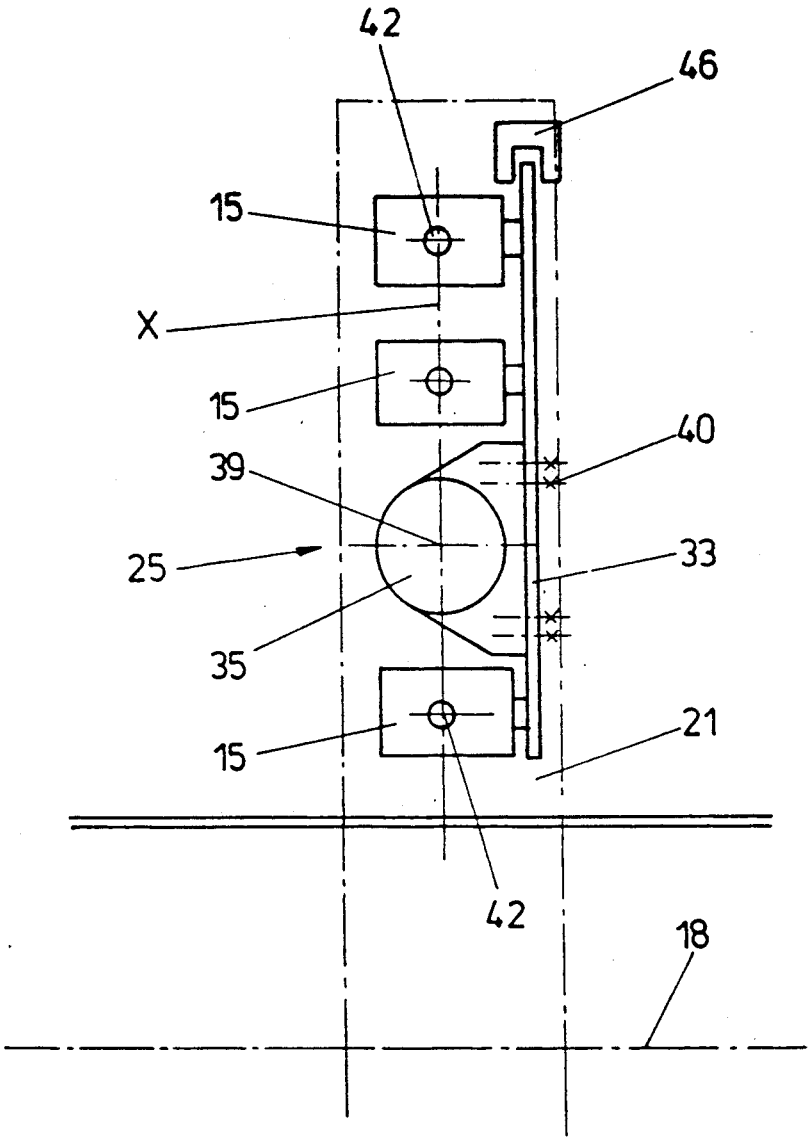
FIG. 4 shows an enlarged plan view of a roof bar.

In FIG. 4, in analogy to the representation according to FIG. 2, only half of the common roof bar 21 is shown in plan view, it again being designed symmetrically to the longitudinal axis 18 of the machine, as in FIG. 2. Once again, the fixing of the plate 33, on which the roof-bolt drilling and setting devices 15 are mounted to the cylinder 35 of the ram 25 can be seen. In order to prevent a twisting of the plate 33 about the center point or the axis 39 of the ram 25 via the bearing designed with crowned supporting surfaces, guides 46 are provided for the plate 33, which ensure that the axes 42 of the roof-bolt drilling and setting devices in each case lie in the center plane X of the roof bar 21. In this way the roof-bolt drilling and setting devices 15, arranged on both sides of the rams 25, lie in the plane of the supporting frame 14 formed by the axes 39 of the rams 25.

The plates also serve in addition for protection of the machine and of operating personnel. The gap or longitudinal slot remaining between the plates for the vertical movement of the shearing arm 3 and, if applicable, the loading ramp, may in this case be partially covered for a further improvement in sealing, for example by flexible elements. Furthermore, a working platform, which is indicated in FIG. 2 by 34, may be fixed on the side of the supporting frame away from the shearing drum 5.

We claim:

1. A shearing machine having roof-bolt drilling and setting devices, said roof-bolt drilling and setting devices being jointedly connected to the shearing machine and adapted to be hydraulically braced between a roof and a floor of one of a roadway and tunnel, wherein a plurality of the roof-bolt drilling and setting devices are connected to a common supporting frame, said supporting frame being connected to the shearing machine via guide bars running in a longitudinal direction of the shearing machine.

2. A shearing machine according to claim 1, wherein the supporting frame comprises:

rams which are adapted to be braced between the floor and the roof, roof bars jointedly connected to the rams, wherein a common roof bar is shared by two rams, and floor support plates.

3. A shearing machine according to claim 2, wherein the roof-bolt drilling and setting devices are disposed between the rams and are further disposed in a plane of the supporting frame formed by axes of the rams.

4. A shearing machine according to claim 2, further comprising a loading device disposed so that the floor support plates are disposed outside a width of the loading device.

5. A shearing machine having roof-bolt drilling and setting devices, said roof-bolt drilling and setting devices being jointedly connected to the shearing machine and adapted to be hydraulically braced between a roof and a floor of one of a roadway and tunnel, wherein a plurality of the roof-bolt drilling and setting devices are connected to a common supporting frame, said supporting frame being connected to the shearing machine via guide bars running in a longitudinal direction of the shearing machine, wherein the guide bars include two upper guide bars and two lower guide bars, the upper and lower guide bars being disposed between the supporting frame and the shearing machine.

6. A shearing machine according to claim 5, wherein the supporting frame comprises:

rams which are adapted to be braced between the floor and the roof, roof bars jointedly connected to the rams, wherein a common roof bar is shared by two arms, and floor support plates.

7. A shearing machine according to claim 6, wherein the roof bar is supported via crowned bearing surfaces disposed on the rams.

8. A shearing machine according to claim 7, wherein the supporting frame is retractable, with its retractability being limited during retraction of the rams by stops.

9. A shearing machine according to claim 8, wherein the stops for limiting retracting movement of the supporting frame include a telescopically slidable strut which is jointedly articulated on the shearing machine and the supporting frame, with a point of articulation of the slidable strut on the shearing machine being different from a point of articulation of the upper guide bar on the shearing machine.

10. A shearing machine according to claim 6, wherein the roofbolt drilling and setting devices are disposed between the rams and are further disposed in a plane of the supporting frame formed by axes of the rams.

11. A shearing machine according to claim 6, wherein the roofbolt drilling and setting devices are connected to plates that are connected to the cylinders of the rams, the plates being guided by guides parallel to the longitudinal axis of the roof bars that crosses a longitudinal axis of the roadway.

12. A shearing machine according to claim 6, further comprising a loading device disposed so that the floor support plates are disposed outside a width of the loading device.

13. A shearing machine according to claim 5, wherein a length of the guide bars which connect the support frame to the shearing machine is designed in such a manner that the supporting frame is inclined so that it is closer to a front of the machine at the roof than it is at the floor.

* * * * *